US005809694A

United States Patent [19]

Postans

[11] Patent Number: 5,809,694

[45] Date of Patent: Sep. 22, 1998

[54] NURSERY GATES

[75] Inventor: Mark Anthony Postans, West Midlands, Great Britain

[73] Assignee: Beldray Limited, West Midlands, United Kingdom

[21] Appl. No.: 817,401

[22] PCT Filed: Sep. 19, 1995

[86] PCT No.: PCT/GB95/02217

§ 371 Date: May 15, 1997

§ 102(e) Date: May 15, 1997

[87] PCT Pub. No.: WO96/12080

PCT Pub. Date: Apr. 25, 1996

[30] Foreign Application Priority Data

Oct. 14, 1994 [GB] United Kingdom ..... 9420715

[51] Int. Cl.[6] ..... E06B 3/68; E05C 5/00; E05C 3/04

[52] U.S. Cl. ..... 49/57; 49/463; 292/5; 292/207

[58] Field of Search ..... 49/55, 57, 463, 49/465, 56, 394, 395; 292/5, 207, 198

[56] References Cited

U.S. PATENT DOCUMENTS

| | | | |
|---|---|---|---|
| 4,611,431 | 9/1986 | Lauro | 49/57 |
| 4,628,635 | 12/1986 | Maillard | 49/57 |
| 4,685,247 | 8/1987 | Alam | 49/57 |
| 5,103,658 | 4/1992 | McQuade | 49/394 |
| 5,117,585 | 6/1992 | Andrisin, III | 49/57 |
| 5,290,077 | 3/1994 | Fleming | 49/395 |
| 5,396,732 | 3/1995 | Andersen | 49/57 |

*Primary Examiner*—Daniel P. Stodola
*Assistant Examiner*—Curtis Cohen
*Attorney, Agent, or Firm*—Welsh & Katz, Ltd.

[57] ABSTRACT

A nursery gate is provided with a pivoted latch. When the gate is swung to a closed position where it is co-planar with the keeper and hinge axis, the latch draw engages the keeper. At that time, a detent provided by the nose and the recess engages due to a spring movement of one of the part in the direction of the hinge axis. The gate is released for opening by a movement in the opposite direction against the spring so as to separate the nose and recess and allow the latch to pivot.

6 Claims, 3 Drawing Sheets

NURSERY GATES

The prevent invention relates to safety barriers intended to be assembled into position so as to form a nursery gate. The position may be at the top or bottom of the stairs or in a doorway; alternatively it may be in a passageway.

EP-A 0 202 851 shows a well known construction comprising an outer frame including two vertical members, one for positioning against each side of the opening which is to be barred by the gate. These two members are connected together by a threshold strip at floor level. Hence the two vertical members and the threshold strip together form a generally "U" shaped structure and the gate per se is located within that, between the two vertical members. Each of the four corners of the construction that is to say the top and bottom of each of the two vertical members has screw adjusters and lock nuts or equivalents, which can be forced against the walls of the passage or like in which the construction is located, to wedge the outer frame in place. Each vertical member may comprise several tubes, wires or the like in the interests of structural rigidity and to avoid deflection when the screw adjusters are tightened. The gate itself is hinged to one of the vertical members at one lateral edge, and latched to the other vertical member at the opposite lateral edge.

The object of the present invention is to provide an improved construction.

Also according to the invention a nursery gate comprises a generally U-shaped structure including a pair of uprights provided with means for wedging the structure in an opening, and a threshold extending at floor level between the uprights, a gate hinged to one of the uprights, and latch means for releasably holding the gate in a position generally co-planar with the said structure, characterised in that the latch includes a jaw pivoted on the gate and engageable with the adjacent side member of the U-structure, a detent for holding the jaw in a non-pivoted position, spring means for retaining the detent in that position, and a release member (which may be the detent itself or a part connected to or associated therewith) for disengaging the detent from the jaw to allow the pivoting to take place.

Preferably the detent includes a nose engaged in a recess, and when disengaged and the jaw is turned, the detent will abut the jaw adjacent the detent recess so that if and when the jaw is pivoted in the reverse direction to re-align the detent and recess the spring will automatically engage the parts together.

Preferably the surface of the jaw which is contacted as mentioned has stop faces so as to limit the relative angular movement of the jaw and prevent it turning beyond the detent.

The detent nose and recess may be reversed so that the detent has a recess and the jaw has a nose instead of vice versa.

According to a feature of the invention, the detent is carried on a rod extending generally vertically in the gate between upper and lower frame members thereof and is fast with that rod, so that when the detent is displaced to free the jaw, the rod is moved in the same direction. The lower end of the rod may project below the gate and into a keeper in the threshold and this provides a second latching point at the bottom of the gate, whereas the jaw may be disposed generally at the top of the gate. When the detent is spring returned, the rod is spring returned. Hence, as the gate is swung shut, the jaw may engage the corresponding part of the U-shaped frame which causes the jaw to pivot about that engagement upon the gate and when it returns into line with the gate the spring will drive the detent into the engaged position and at the same time drive the rod so as to engage the lower end thereof with the keeper.

One embodiment of the invention using a U-frame is now more particularly described with reference to the accompanying drawings wherein.

Figure 4:
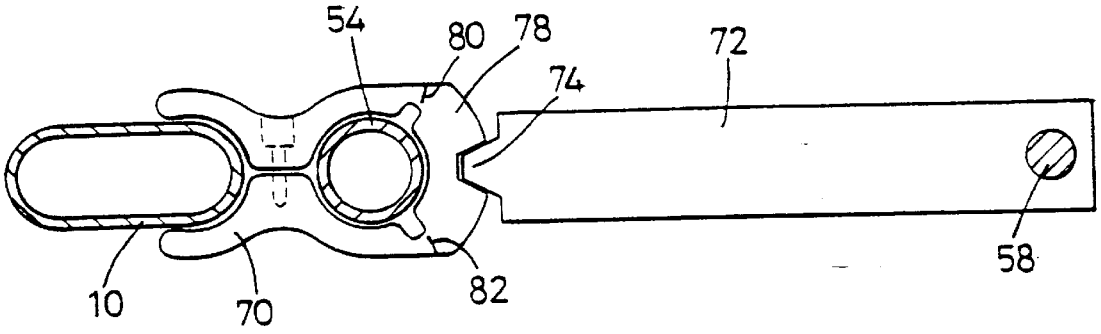
FIGS. 4 and 5 are somewhat diagrammatic sectional plans taken on the line 5—5 (FIG. 1) and showing the gate in two different positions.
Figure 5:
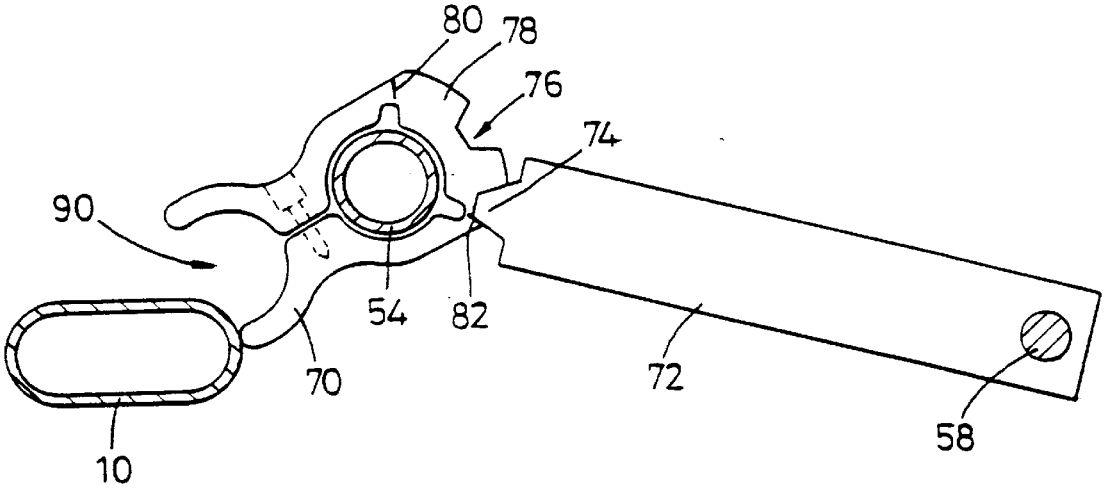

Referring to the drawings, the U-shaped frame comprises a pair of generally parallel uprights 10,12 which, as best seen in FIGS. 4 and 5 may comprise oval or rectangular tube rather than circular or square tube so as to have a substantial stiffness particularly against deflection in the plane of the U shape, and connected together by a threshold member 14 which is preferably of rectangular section tube having its major axis in the same plane and for the same reason.

The opposite ends of the tube 14 are open to receive plugs forming part of adjuster assemblies, and a short length of square section tube 16,18 is provided at the top end of each of the members 10,12. the open end of tube 16 may be closed by plug 20 but the end of tube 18 at 20 may be closed by a bracket carrying the hinge pin 60. The remote ends of tubes 16,18 receive further parts of the adjuster system.

In the free state, the U-shaped member 10,12,14 has the parts 10,12 diverging from the threshold member and when correctly assembled and installed in a passageway, doorway or the like, the members are brought in to generally parallel condition so as to exert a spring force assisting in retention of the U-shaped frame in the required location.

Figure 1:
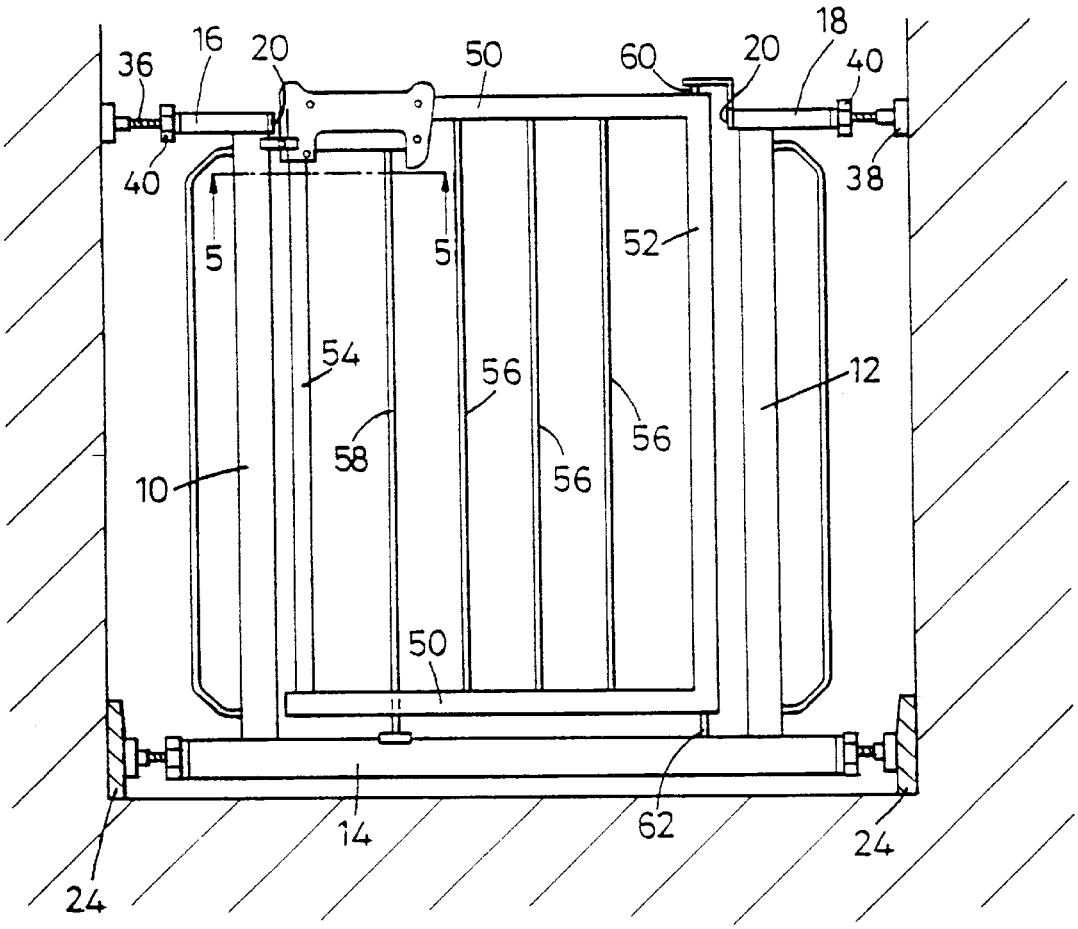
FIG. 1 is an elevation showing a nursery gate installed in a passageway.

It will be appreciated that the passageway, doorway or the like may have walls which are non-parallel or of different dimensions at different points, and as an illustration of this, skirting board 24 are shown in FIG. 1. Hence the well understood need for adjusters to take up different dimension gaps at effectively the four corners of the U-shaped frame.

Figure 2:
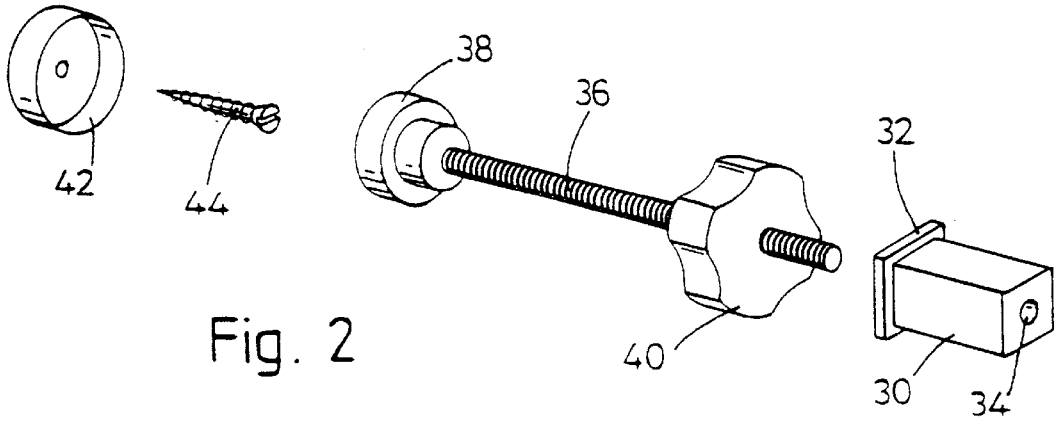
FIG. 2 is an exploded perspective view on an enlarged scale showing one of the adjusters used to wedge the U-shaped structure in the passageway.

One typical adjuster assembly is illustrated in FIG. 2 and comprises a plastics plug 30 provided with rim 32 at one end, the plug being dimensioned to be received within the appropriate tube end (14,16 or 18) with the part 32 seating on the end edge. The plug is apertured at 34 to freely receive screw shank 36, and the screw has an enlarged head, conveniently moulded around the screw, and a loose nut adjuster 40 has a complementary screwthread. The head 38 is conveniently to be received in a cup 42, which can be secured to the wall, skirting board, door frame or the like as required by an appropriate wood screw 44.

As shown in FIG. 1, an adjuster set as in FIG. 2 is disposed at each of the four corners, and by appropriate rotation of the nuts 40 the heads 38 are displaced towards the respective walls so as to wedge the U frame in place and make the members 10,12 parallel as previously mentioned.

The gate itself may comprise upper and lower tube members 50, which in this illustrated example are square tubes, joined by a number of rods or tubes to provide the barrier. In the illustrated example, tube 52 at the gate hinge end is square, and tube 54 at the free or latch end is of circular cross-section, and in between are a number of parallel and smaller diameter rods 56 which extend between the upper and lower tube members 50. These parts may be welded together to provide the required structural integrity.

A further barrier member is provided in the form of rod 58 which may be equispaced with the rods 56 between the tubes 52,54 and this part 58 has a bottom latching function as more particularly described hereinafter.

The gate is hinged by pins 60,62 which may be fast with the gate and engaged in a bracket at the top of the U member 12 and in an aperture in the threshold member 14 respectively.

Figure 3:
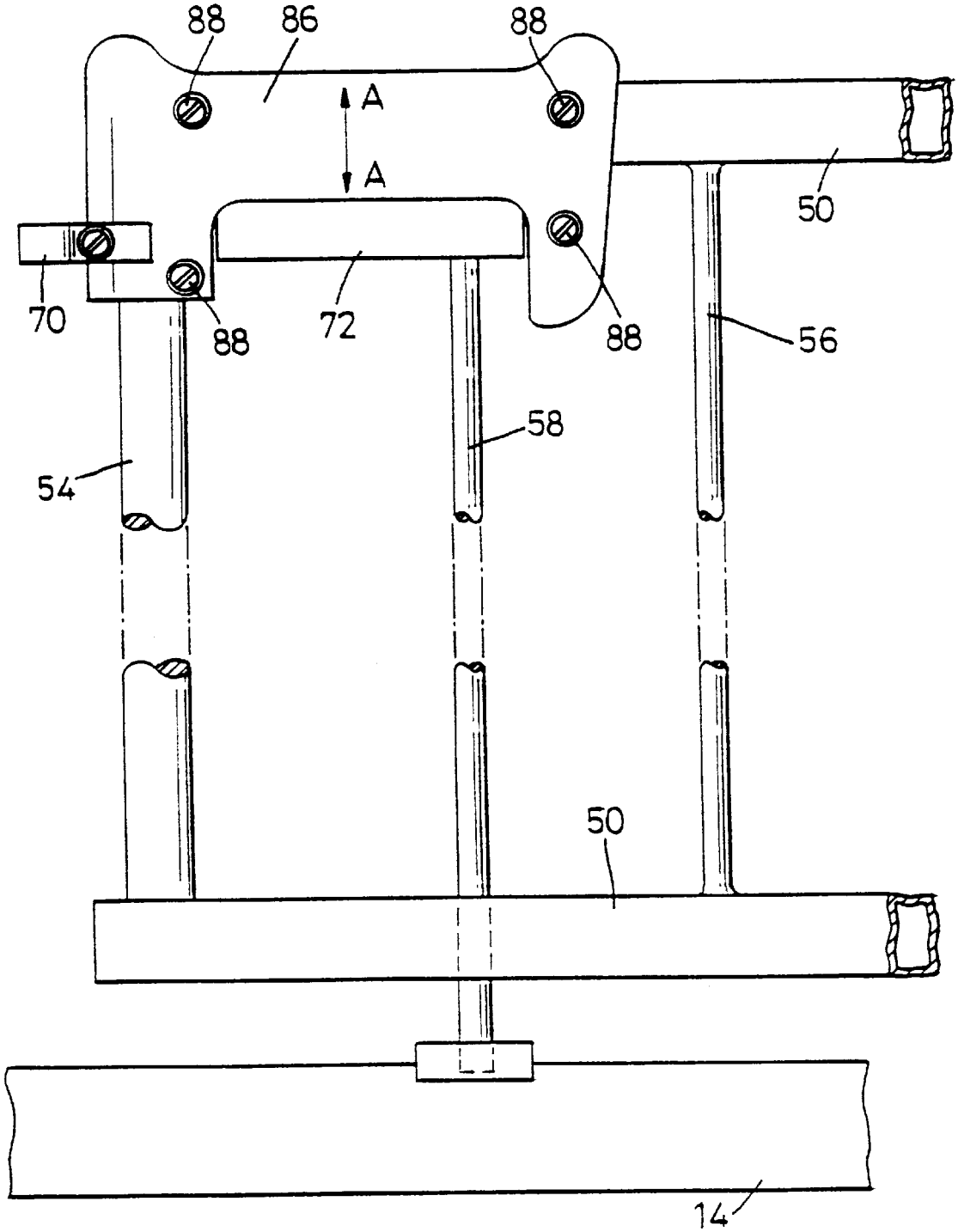
FIG. 3 is a fragmentary elevation view on an enlarged scale compared to FIG. 1.

Turning now to the gate latch mechanism, and in particular to FIGS. 4 and 5, jaw 70 is pivoted on the gate member 54 and is engageable with the U frame member 10 as shown in FIG. 4 which shows a closed and locked position of the gate. The jaw is held in that position by latch 72 which has a latching nose 74 engageable in a recess 76 in the jaw structure. Latch 72 is guided for movement in the direction of the arrows A FIG. 3, is spring urged to a position coplanar with the jaw 70 as also seen in FIG. 3 but is displaceable (upwardly in FIG. 3) against the spring so as to lift the nose 74 out of the recess 76 and allow it to ride on the upper surface 78 of the jaw between a pair of end abutment shoulders 80,82 provided on that jaw. However, these abutments are not essential, as any over-travel can be manually corrected. The sliding movement is guided by the walls of a cavity in a hand grip part 86 which is assembled about the tubes 50,10, for example being made in a pair of mirror image parts assembled together and held for example by screws 88.

The latch 72 is fast with the latch rod 58 and the latter is further guided for movement in the direction of the arrow A by extending through aligned apertures in the lower of the tubes 50 adjacent the threshold bar 14. The lower end of the rod 58 is receivable in a latching recess in the bar 14. In the FIG. 4 position of the jaw and latch parts 70–76 the lower end of the rod 58 is so received in the bar 14 and the gate is effectively held closed and in the same plane as the U frame at four points namely the two hinge points and at the jaw 70 and the lower end of the latch rod 58, and thus effectively at all four corners of the gate.

Release of the gate for opening in either direction is effected by displacing the latch 72 upwardly, so as to release the formation 74 from the drawer 76 and at the same time lift the lower end of the rod 58 out of the threshold bar 14. The gate can then be hinged in either direction to an open position and this is accompanied by pivoting of the jaw 70 on the tube 54 to disengage the jaw 90 from the tube 10 as shown in FIG. 5. Further opening movement of the gate in either direction does not affect the position of the parts and it will be noted that when the latch 72 is released it is prevented from being spring driven to the FIG. 4 position because the nose 74 will rest on the upper surface of the jaw 70.

The gate may now be swung shut and when it does so, the jaw will encounter the tube 10 and be pivoted back to the position shown in FIG. 4 which will automatically align the recess 76 with the nose 74, and the spring (not shown) will then return the latch 72 to the coplanar position driving the nose 74 into the recess 76. In normal usage, this can only occur when the gate is in the closed position (FIG. 4) and as the latch becomes aligned the latch rod 58 will be displaced axially to re-engage at its lower end in the threshold bar 14. However, providing the stop faces 80,82 are not used, or are overridden, the latch can be turned manually beyond its normal maximum angle, which will prevent the automatic latching when the gate is moved to a closed position.

The jaw 90 has a shape complementary to the relevant part of the upright 10 which in this embodiment is effectively semi-circular. It is possible to make the invention (in this respect) work with different shapes even including a rectangular upright, for example but without limitation by making the recess 90 cut-away so that only spaced points along the (arcuate in FIGS. 4 and 5) jaw 90 contact the tube 10. But the illustrated arrangement is simplest and preferred.

It will be seen that a manual operation to displace the latch bar 72 is necessary to open the gate, and that once done so the gate can be swung open in either direction. The gate can be relatched from either direction by merely slamming it or swinging it to the closed position without it being necessary to operate the latch 72 manually. The operation by which the jaw 70 and detent 72 move into line during closing the gate will be seen by comparing the position of the parts in FIGS. 4 and 5.

I claim:

1. A nursery gate assembly for restricting travel between opposing vertical surfaces, said assembly including opposing first and second vertical posts mountable between said vertical surfaces;

a gate assembly having a gate having free end and a pivotal end, said pivotal end hingedly mounted on said first vertical post for pivotal movement of said gate from a first open position to a second closed position;

a latch mechanism on said free end of said gate positioned for engagement with said second vertical post, said latch mechanism comprising a jaw pivotable about an axis parallel with the longitudinal axis of said second vertical post from an open unlatched position to a closed latched position in engagement with said second vertical post; and having a U-shaped end engageable with said second vertical post and a recess at a opposite end thereof;

a latch on said free end of said gate, said latch having a nose projecting therefrom engageable with said recess for retaining said jaw in said latched position; said nose being disengaged from said recess for placing said jaw in said open position upon displacement of said latch.

2. A gate as claimed in claim 1 wherein the detent includes a nose engaged in a recess and arranged so that when the detent is disengaged and the jaw is turned, the detent abuts the jaw adjacent the detent recess.

3. A gate as claimed in claim 2 wherein spring means are arranged to automatically re-engage the detent when turned to align the nose and recess.

4. A gate as claimed in claim 3 wherein the surface of the jaw contacted by the detent has stop faces to limit angular movement.

5. A gates as claimed in claim 1 wherein the detent is carried on a rod extending vertically in the gate between upper and lower frame members and extending beyond the rod for latching engagement with a threshold keeper.

6. A gate as claimed in claim 1 wherein the jaw includes an arcuate recess and the adjacent side member of the U-structure is of similar arcuate cross-section.

* * * * *

UNITED STATES PATENT AND TRADEMARK OFFICE

CERTIFICATE OF CORRECTION

PATENT NO. : 5,809,694

DATED : September 22, 1998

INVENTOR(S) : Mark Anthony Postans

It is certified that error appears in the above-identified patent and that said Letters Patent is hereby corrected as shown below:

Column 4, line 26, after "having" insert --a--.

line 37, delete "a" and insert --an--.

line 44, after "gate" insert --assembly--.

line 44, delete "detent" and insert --latch--.

line 44, after "includes" insert --a detent and--.

line 45, remove "a" (both instances) and insert --the--(both instances).

line 48 after "gate" insert --assembly--.

line 49, delete "detent" and insert --latch--.

UNITED STATES PATENT AND TRADEMARK OFFICE

CERTIFICATE OF CORRECTION

PATENT NO. : 5,809,694

DATED : September 22,1998

INVENTOR(S) : Mark Anthony Postans

It is certified that error appears in the above-identified patent and that said Letters Patent is hereby corrected as shown below:

line 51 after "gate" insert --assembly--.

line 52, delete "detent" and insert --latch--.

line 54, delete "gates" and insert -gate assembly--.

line 54, delete "1" and insert --2--.

line 54, delete "detent" and insert --latch--.

line 58, after "gate" insert --assembly--.

line 59, delete the first instance of "the" and insert --an--.

Signed and Sealed this

Third Day of August, 1999

*Attest:*

Q. TODD DICKINSON

*Attesting Officer*

*Acting Commissioner of Patents and Trademarks*